US006815878B2

(12) United States Patent
Bryant

(10) Patent No.: US 6,815,878 B2
(45) Date of Patent: Nov. 9, 2004

(54) HIGH TEMPERATURE LAMP

(75) Inventor: Johnny Dewayne Bryant, Cookeville, TN (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 2 days.

(21) Appl. No.: 10/392,501

(22) Filed: Mar. 20, 2003

(65) Prior Publication Data

US 2003/0178926 A1 Sep. 25, 2003

Related U.S. Application Data

(60) Provisional application No. 60/366,192, filed on Mar. 21, 2002.

(51) Int. Cl.[7] ..... H01J 5/48
(52) U.S. Cl. ..... 313/318.01; 313/317; 313/318.05
(58) Field of Search ..... 313/317, 318.01, 313/318.05

(56) References Cited

U.S. PATENT DOCUMENTS

| | | | |
|---|---|---|---|
| 4,603,278 | A | 7/1986 | Devir et al. |
| 4,658,178 | A | 4/1987 | Bradley et al. |
| 4,724,353 | A | 2/1988 | Devir |
| 4,752,710 | A | 6/1988 | Devir et al. |
| 4,877,992 | A | 10/1989 | Devir |
| 4,883,434 | A | 11/1989 | Toyoshima |
| 4,950,942 | A | 8/1990 | Braun et al. |
| 4,979,082 | A | 12/1990 | Devir |
| 4,988,912 | A | 1/1991 | Borgis |
| 5,008,588 | A | 4/1991 | Nakahara |
| 5,105,119 | A | 4/1992 | Dayton |
| 5,186,669 | A | 2/1993 | Holman et al. |
| 5,229,683 | A | 7/1993 | Eckhardt et al. |
| 5,281,889 | A | 1/1994 | Fields et al. |
| 5,294,865 | A | 3/1994 | Haraden |
| 5,319,532 | A | 6/1994 | Pidancet |
| 5,440,199 | A | 8/1995 | Heindl et al. |
| 5,486,991 | A | 1/1996 | Bodem, Jr. |
| 5,500,566 | A | 3/1996 | Talmon-Gros |
| 5,747,919 | A | 5/1998 | Gandhi et al. |
| 5,760,537 | A | 6/1998 | Friederichs |
| 5,865,647 | A | 2/1999 | Garber et al. |
| 6,008,570 | A | 12/1999 | Helbig et al. |
| 6,056,417 | A | 5/2000 | Cheng |
| 6,083,050 | A | 7/2000 | Hsu |
| 6,232,707 | B1 | 5/2001 | Ranish et al. |

*Primary Examiner*—Vip Patel
(74) *Attorney, Agent, or Firm*—Reising, Ethington, Barnes, Kisselle, P.C.

(57) ABSTRACT

An incandescent automotive lamp having a glass envelope with a polyetherimide sleeve attached to a press-sealed end of the glass envelope. The sleeve includes a base portion having an interior passage that permits the sleeve to be slid onto the press-sealed end. Attached to the base portion of the sleeve are a pair of opposed locking members, with each locking member having a free, cantilevered end located near the bottom side of the base portion. When the sleeve is assembled onto the press-sealed end of the glass envelope, the free end engages an associated bearing surface on the press-sealed end which inhibits the sleeve from sliding back off the glass envelope. The polyetherimide sleeve is capable of withstanding relative high temperature operation of the lamp without outgassing of the plastic, and the locking members allow secure attachment of the sleeve to the glass envelope without cracking of the polyetherimide material.

20 Claims, 3 Drawing Sheets

HIGH TEMPERATURE LAMP

CROSS-REFERENCE TO RELATED APPLICATION

This application claims the priority of U.S. Provisional Application Ser. No. 60/366,192, filed Mar. 21, 2002, the entire contents of which are hereby incorporated by reference.

TECHNICAL FIELD

This invention relates to lamps and, in particular, to automotive incandescent and other such lamps used in lighting assemblies where the lamp operation can raise the temperature of its plastic components sufficiently high to cause outgassing of those components.

BACKGROUND OF THE INVENTION

Outgassing of plastics used in exterior vehicle lighting applications is known to cause fogging of the lenses which can adversely affect the appearance and aesthetics of the lens. See, for example, U.S. Pat. No. 6,012,830 to Frazier which discloses a light shield for a vehicle headlamp that uses a titanium carbide coating that reportedly does not outgas over the life of the headlamp. Outgassing has been traced to the release of volatiles from the resin as a result of the polymerization process of some resins. This is particularly true where exterior vehicle incandescent lamps are used in conjunction with a plastic components, since the heat output of the lamps can raise the temperature of the components to 200° F.–450° F.

One component most directly affected by heat from an automotive incandescent lamp is the plastic sleeve used on certain press-seal (wedge-base) lamps to retain the lead wires in place on the lamp and to provide a mating interface between the lamp and a separate socket. Such lamps are well known in the art. See, for example, U.S. Pat. Nos. 5,186,669 to M. R. Holman et al.; 5,486,991 to G. E. Talmon-Gros et al.; and 5,486,991 to J. D. Bodem et al. These sleeves have traditionally been made from plastic and are designed to slide onto the press-seal base of the lamp and past a set of protrusions on the bulb which thereafter operate to retain the sleeve in place by an interference fit of the sleeve on the bulb's press-seal base. For this purpose, plastics such as 40% mineral-filled nylon have been used which have sufficient resiliency to permit the sleeve to deform as it passes over the protrusions.

SUMMARY OF THE INVENTION

In accordance with one aspect of the present invention, there is provided a lamp having a glass envelope with a polyetherimide sleeve attached to a sealed end of the glass envelope. The glass envelope includes an interior space and a filament or other light emitting element contained within the interior space. The light emitting element is at least partially supported by a plurality of lead wires that extend from the interior space through the glass envelope to an exposed location at the sealed end. The sleeve includes a base portion having an interior passage, with the sleeve being located on the sealed end such that the sealed end extends through the interior passage. The polyetherimide sleeve is capable of withstanding relative high temperature operation without outgassing of the plastic.

In accordance with another aspect of the invention, the lamp is designed such that the sleeve, whether formed from polyetherimide or some other material, includes a locking member in contact with the sealed end. The sealed end includes a bearing surface and the locking member engages the bearing surface such that the sleeve is inhibited from moving away from the interior space and becoming separated from the sealed end. The locking member has a first end attached to the base portion with the locking member extending along the interior passage from the first end to a second, free end that is in engagement with the bearing surface. The first end of the locking member is flexibly attached to the base portion such that the free end can be flexed outwardly away from the interior passage while providing an inwardly directed force. This permits the sleeve to be assembled onto the sealed end and slid towards the interior space with the free end being flexed outwardly during movement of the sleeve towards the interior space and the free end thereafter moving inwardly towards the passage when the free end reaches and engages the bearing surface.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
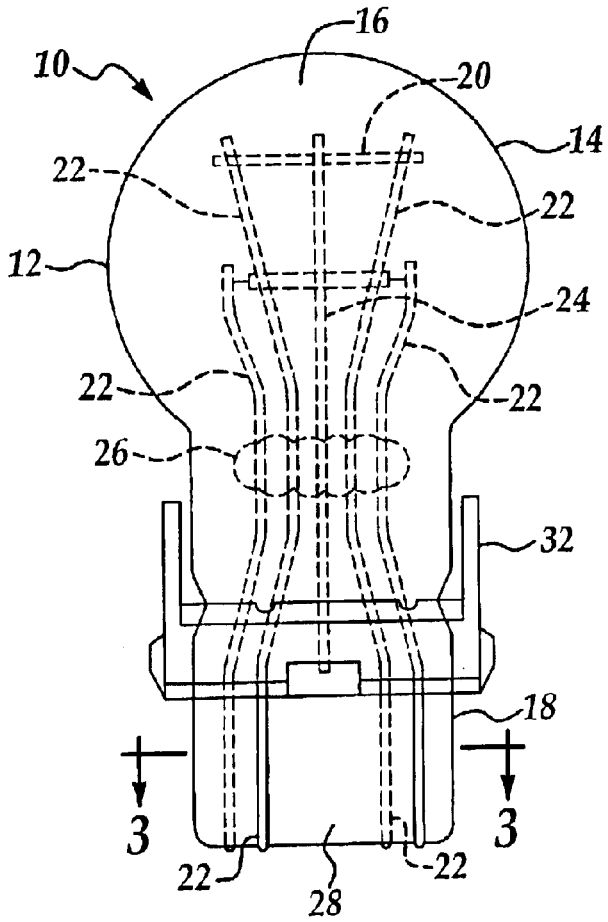
FIG. 1 is a front view of an incandescent lamp constructed in accordance with the present invention.
Figure 3:
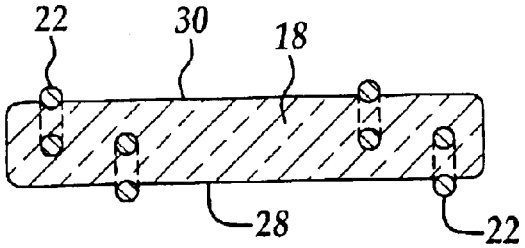
FIG. 3 is a cross-sectional view taken along the 3—3 line of FIG. 1.
Figure 2:
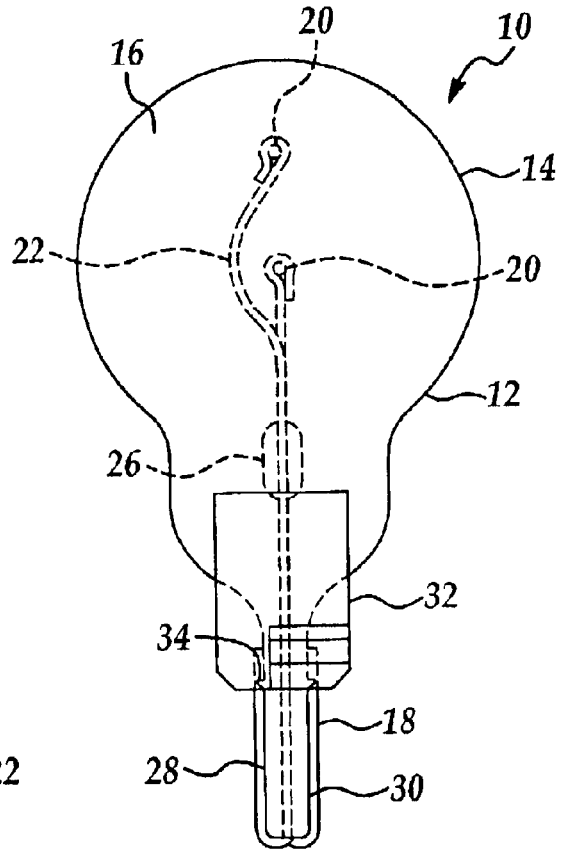
FIG. 2 is a side view of the lamp of FIG. 1.

FIGS. 1–3 depict an incandescent lamp 10 suitable for use in exterior vehicle lighting applications, such as braking and signal lighting. This lamp can be used as a part of any of a number of different vehicle lamp assemblies, such as are shown in U.S. Pat. Nos. 5,536,174 to J. A. Forish, 5,035,643 to J. A. Forish et al., and 5,486,991 to J. D. Bodem Jr., the complete disclosures of which are hereby incorporated by reference.

The lamp 10 includes sealed glass envelope 12 having a bulbous portion or end 14 defining an interior space 16 and a press-sealed end 18. Contained within envelope 12 are a pair of filaments 20, one of which is supported by a pair of lead wires 22 and the other of which is supported by a second set of lead wires 22 as well as a filament vibration dampening wire 24. The lead wires 22 and dampening wire 24 all extend down into the press-seal portion 18 of the envelope 12 which fixes their position within the interior space 16. A vitreous bridge 26 located intermediate the sealed end 18 and filaments 20 is used to fix the spacing between the wires 22, 24 and to lessen their vibration. The lead wires 22 extend from the interior space 16 through the press-sealed end 18 of the glass envelope to an exposed location at the bottom edge of the sealed end 18. The wires 22 are routed up along each of the two opposing sides 28, 30 of the sealed end and are protected at their terminal ends by a plastic sleeve 32 that is attached over the sealed end 18. Sleeve 32 has a pair of internal locking members that each engage a corresponding protrusion 34 on the press-sealed end 18 to prevent the sleeve from slipping off the bulb 12. The details and features of this locking arrangement will be described further below. Glass envelope 12, with its filaments, wires, sealed end, and protrusions, can be made in a conventional manner, as described in U.S. Pat. Nos. 5,186,669 to M. R. Holman et al. and 5,486,991 to G. E. Talmon-Gros et al., the complete disclosures of which are hereby incorporated by reference. Suitable, existing GT-8 bulbs utilizing prior art sleeves are also commercially available from the Wagner Lighting division of Federal-Mogul Corporation.

Sleeve 32 is made from polyetherimide (PEI) such as is available from General Electric under the trademark Ultem. The use of polyetherimide resins in the molding of plastic components is known to those skilled in the art and conventional molding processes can be used to manufacture sleeve 32. Since, as is known, the polyetherimide resin is molded using higher temperatures than the plastics conventionally used for these sleeves, an oil-cooled mold can be used in the molding process. This and other necessary or desirable modifications of the standard sleeve molding process will be apparent to those skilled in the art.

The resulting PEI sleeve has been found to work well in the operating temperature range of 200° F.–450° F. commonly encountered for incandescent automotive lamps without exhibiting the outgassing that normally occurs with conventional lamp sleeve plastics. Although conventional sleeve designs can be utilized with the polyetherimide plastic, the resulting sleeve can be more prone to cracking during assembly of the sleeve onto the sealed end when it is snapped over the protrusions 34. To reduce the possibility of such cracking, sleeve 32 does not utilize a fixed surface feature on the sleeve that requires the sleeve body to be deformed as it is assembled onto the bulb 12 over the protrusions 34; rather, it uses independently flexible locking members to provide a positive engagement of the locking members with the protrusions 34.

Figure 4:
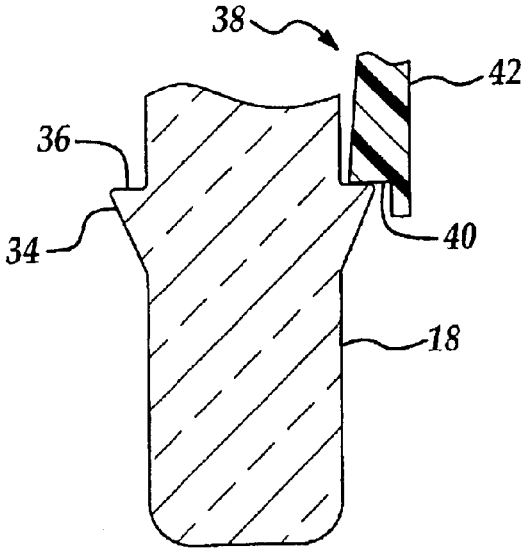
FIG. 4 is an enlarged, fragmentary cross-sectional view taken vertically through a portion of the press-seal of the lamp of FIG. 1 to show the structural features of the press-seal and sleeve of the lamp that are used to retain the sleeve in place on the lamp.
Figure 5:
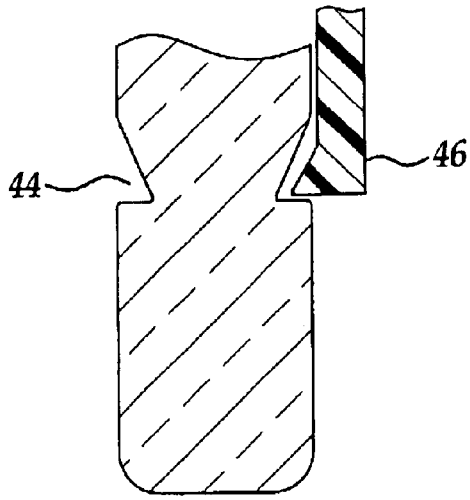
FIG. 5 is an enlarged, fragmentary cross-sectional view as in FIG. 4, but showing an alternative embodiment for retaining the sleeve on the press-sealed end of the lamp of FIG. 1.
Figure 6:
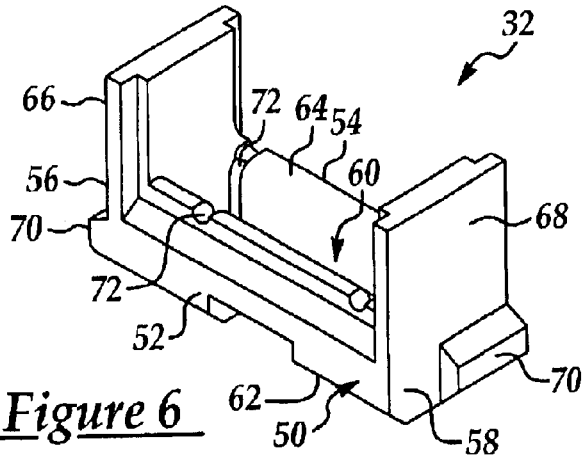
FIG. 6 is a perspective view of the sleeve of FIG. 1.

FIG. 4 shows this arrangement in expanded detail wherein the sealed end portion of the bulb is shown with only (one of) the locking member portions of the sleeve being shown. As indicated, the protrusions 34 on the sealed end of bulb 12 each include a bearing surface 36. When the sleeve 32 has been fully assembled onto the sealed end, the locking member, or tab, 38 is located above the bearing surface 36 in engagement therewith to prevent the sleeve from coming off the sealed end. More specifically, as shown the locking tab has an engagement surface 40 on its lower end 42 that faces away from the upper bulb portion of the lamp 10 and that is in contact with the bearing surface 36 to prevent the sleeve from moving back down the sealed end 18. The disclosed implementation for this locking tab 38 as a part of sleeve 32 will be described further below. It will be appreciated by those skilled in the art that, rather than utilizing the protrusions 34 shown in FIG. 4, notches 44 into the glass of sealed end 18 could instead be used to provide a bearing surface, as depicted in FIG. 5. The locking tab could then be implemented as a pawl 46 that snaps into place within the recess to thereby lock the sleeve in place on the sealed end 18. Other such arrangements for providing positive locking of the sleeve onto the sealed glass end can be used as well.

Turning now to the remaining figures, further details of the construction and use of the sleeve 32 will now be provided. Sleeve 32 includes a rectangular base portion 50 having a pair of opposed walls 52, 54 that extend lengthwise between a pair of end walls 56, 58. These four walls define an interior passage 60 into which the sealed end 18 of the bulb 12 passes during assembly. The base portion 50 has a bottom end 62 and a top end 64. Extending up from the end walls 56, 58 are a pair of opposed side walls 66, 68 that are actually continuous extensions of those end walls. Each of the end walls 56, 58 includes a lateral extension 70 which is used in a known manner to aid in the insertion of the lamp into a mating electrical socket (not shown).

Figure 7:
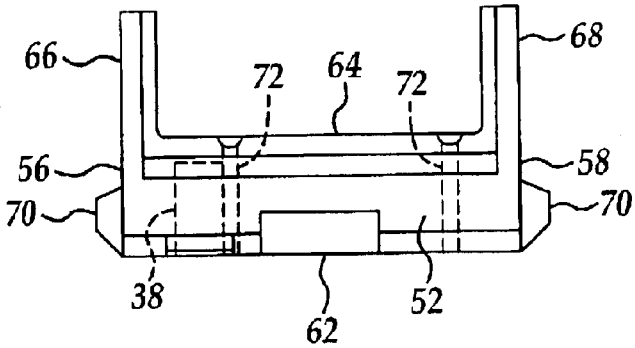
FIG. 7 is a front view of the sleeve shown in FIG. 6.
Figure 8:
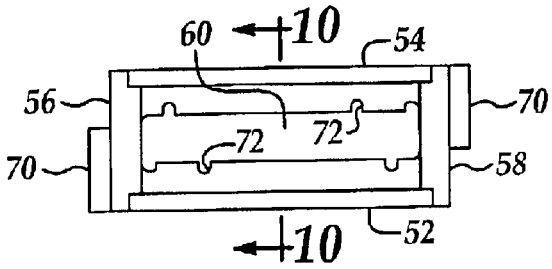
FIG. 8 is a top view of the sleeve of FIG. 6.
Figure 9:
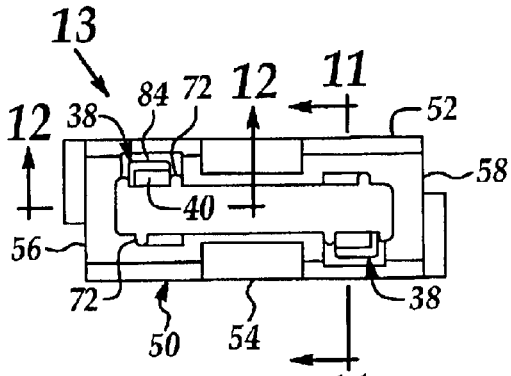
FIG. 9 is a bottom view of the sleeve of FIG. 6.
Figure 10:
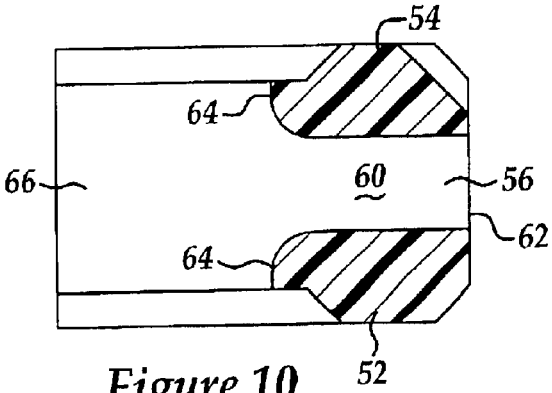
FIG. 10 is a cross-sectional view taken along the 10—10 line of FIG. 8.

The sleeve 32 includes a wire slot 72 for each of the four lead wires used to provide electrical power to the filaments 20. As indicated in FIGS. 7 and 9, each of the two longitudinal walls 52, 54 include two of these wire slots 72 along with one of the two locking tabs 38. The locking tabs are located to one side of their respective walls 52, 54 and, as indicated in FIG. 9, the two walls 52, 54 have exactly the same conformation as each other, but are simply transposed, although this symmetry is not necessary. One of the two wire slots on each wall 52, 54 is adjacent that wall's locking tab 38 and the other wire slot is spaced toward the opposite end wall.

Figure 13:
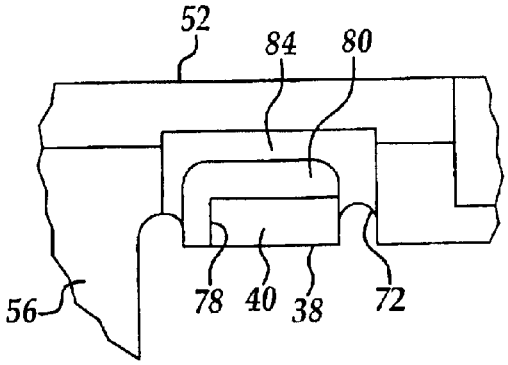
FIG. 13 is an enlarged, fragmentary view of the detail 13 shown in FIG. 9.

The locking tabs 38 will now be described in greater detail in connection with FIGS. 9, 11, and 13, and it will be understood that in the illustrated embodiment the construction and use of each locking tab is identical. The locking tab 38 is a unitary portion of sleeve 32 and is connected to the base portion 50 at a location near the top end 64. The locking tab includes a first end 76 that forms a live hinge where it connects to the base portion 50 near top end 64. The tab extends downward along the interior passage 60 of the sleeve from the first end to a second, free end. It is this free end 42 that is shown in FIG. 4 and that includes the engagement surface 40 which contacts the bearing surface 36 of the bulb to lock the sleeve in place. Thus, it will be appreciated that this engagement surface 40 faces downwardly, away from the bulbous portion of the lamp. Extending past the engagement surface on two sides are a pair of walls 78, 80 that together form a corner which partially wraps around the side of its corresponding protrusion when the sleeve is assembled onto the bulb. As can be seen with reference to FIG. 9, these walls on the one locking tab 38 prevents lateral movement of the sleeve to the right when assembled onto the sealed end and the other locking tab prevents lateral movement to the left. Thus, the two locking tabs coact with the protrusions of the bulb to center the sleeve on the sealed end of the bulb and to inhibit any lateral movement of the sleeve on the bulb.

Figure 11:
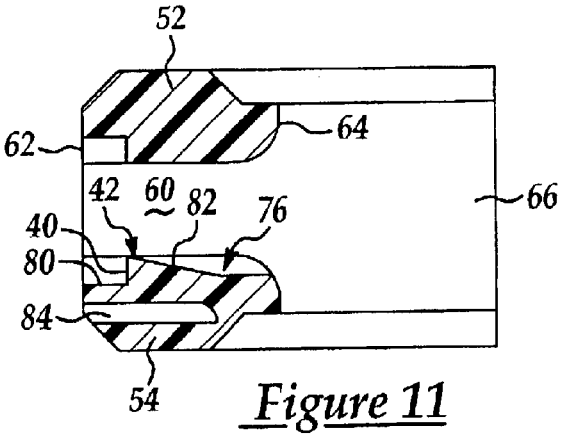
FIG. 11 is a cross-sectional view taken along the 11—11 line of FIG. 9.
Figure 12:
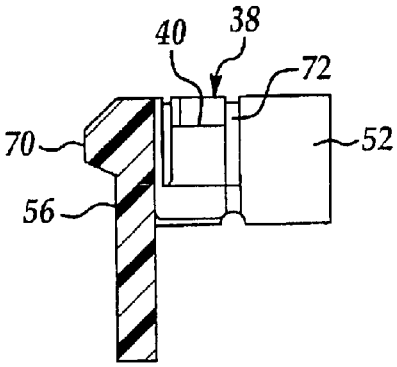
FIG. 12 is a cross-sectional view taken along the 12—12 line of FIG. 9.

As shown in FIG. 11, locking tab 38 can have a ramped surface 82 which bears against the sealed end (or at least its protrusion 34) as the sleeve is assembled onto the bulb 12. A clearance space 84 between the locking tab 38 and the remainder of the side wall 52 permits the free end 42 to flex outwardly away from its relaxed stated adjacent the interior passage 60 during assembly. When flexed outwardly from its relaxed state, the resiliency of the plastic material provides an inward force towards the passage way so that the locking tab bears against the sealed end of the bulb until the tab passes by the protrusion on the bulb, at which point it can return to (or almost nearly to) its relaxed position shown in FIG. 11. The belly of the bulb 12 (i.e., the region between the bulbous portion 14 and the press-sealed end 18) is dimensioned and located relative to the protrusions 34 and shape of the sleeve 32 such that the sleeve comes into contact with the expanding portion of the belly just as the locking tabs 38 snap over the protrusions so that the sleeve is inhibited from further movement up the sealed end towards the bulbous portion. As mentioned above, these dimensional characteristics of bulb 12 are well known and lamps having these dimensional characteristics are commercially available.

The use of the locking tabs rather than requiring deformation of the sleeve base walls provides less strain on the polyetherimide plastic. The result is a lamp than can be operated at high temperatures without cracking of the sleeve during assembly and without outgassing of the sleeve plastic during operation of the lamp.

It will thus be apparent that there has been provided in accordance with the present invention a high temperature lamp which achieves the aims and advantages specified herein. It will of course be understood that the foregoing description is of preferred exemplary embodiments of the invention and that the invention is not limited to the specific embodiments shown. Various changes and modifications will become apparent to those skilled in the art. For example, the polyetherimide sleeve could be provided with features other than the locking members to secure it to the lamp envelope. Alternatively, the sleeve including its locking member(s) can be made from suitable materials other than polyetherimide. All such variations and modifications are intended to come within the scope of the appended claims.

As used in this specification and appended claims, the terms "for example" and "such as," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that necessarily requires a different interpretation.

I claim:

1. A lamp, comprising:

a glass envelope having an interior space and a sealed end that includes a bearing surface;

a light emitting element contained in said interior space;

a plurality of lead wires at least partially supporting said light emitting element in said interior space, said lead wires extending from said interior space through said glass envelope to an exposed location at said sealed end;

a plastic sleeve attached to said glass envelope at said sealed end, said sleeve having a base portion that includes an interior passage, with said sleeve being located on said sealed end such that said sealed end extends through said interior passage;

wherein said sleeve includes a locking member in contact with said bearing surface such that said sleeve is inhibited from moving away from said interior space and becoming separated from said sealed end, said locking member having a first end attached to said base portion with said locking member extending along said interior passage from said first end to a second, free end that is in engagement with said bearing surface, said first end of said locking member being flexibly attached to said base portion such that said free end can be flexed outwardly away from said interior passage while providing an inwardly directed force, whereby said sleeve can be assembled onto said sealed end and slid towards said interior space with said free end being flexed outwardly during movement of said sleeve towards said interior space and said free end thereafter moving inwardly towards said passage when said free end reaches and engages said bearing surface.

2. A lamp as defined in claim 1, wherein said locking member extends along said interior passage from said first end to said free end in a direction away from said interior space.

3. A lamp as defined in claim 2, wherein base portion includes a bottom end and a top end and said free end is located proximate said bottom end.

4. A lamp as defined in claim 3, wherein said free end includes an engagement surface facing away from said interior space and in contact with said bearing surface, whereby said sleeve is inhibited from moving away from said interior space by engagement of said engagement surface with said bearing surface.

5. A lamp as defined in claim 4, wherein said free end includes at least one wall extending past said engagement surface in a direction away from said interior space.

6. A lamp as defined in claim 2, wherein said sleeve includes a pair of opposed side walls extending from said base portion towards said interior space.

7. A lamp as defined in claim 1, wherein said sleeve includes a wire slot along said interior passage adjacent said locking member.

8. A lamp as defined in claim 7, wherein one of said lead wires extends along a surface of said sealed end and into said wire slot.

9. A lamp as defined in claim 1, wherein said sleeve includes a locking member on an opposite side of said inferior passage.

10. A lamp as defined in claim 1, wherein said sleeve comprises polyetherimide and said locking member is a unitary portion of said sleeve.

11. A lamp as defined in claim 1, wherein said sealed end comprises a press-sealed end having first and second opposing sides, at least one of which includes said bearing surface.

12. A lamp as defined in claim 11, wherein said bearing surface is located on the first side of said press-sealed end, and wherein said lamp further comprises a second bearing surface located on the second side of said press-sealed end.

13. A lamp as defined in claim 1, wherein said free end of said locking member is spaced from said base portion by a clearance space.

14. A lamp, comprising:

a glass envelope having an interior space and a sealed end;

a light emitting element contained in said interior space;

a plurality of lead wires at least partially supporting said light emitting element in said interior space, said lead wires extending from said interior space through said glass envelope to an exposed location at said sealed end;

a polyetherimide sleeve attached to said glass envelope at said sealed end, said sleeve having a base portion that includes an interior passage, with said sleeve being located on said sealed end such that said sealed end extends through said interior passage.

15. A lamp as defined in claim 14, wherein said sealed end includes a bearing surface, and wherein said sleeve includes a locking member in contact with said bearing surface such that said sleeve is inhibited from moving away from said interior space and becoming separated from said sealed end, said locking member having a first end attached to said base portion with said locking member extending along said interior passage from said first end to a second, free end that is in engagement with said bearing surface, said first end of said locking member being flexibly attached to said base portion such that said free end can be flexed outwardly away from said interior passage while providing an inwardly directed force, whereby said sleeve can be assembled onto said sealed end and slid towards said interior space with said free end being flexed outwardly during movement of said sleeve towards said interior space and said free end thereafter moving inwardly towards said passage when said free end reaches and engages said bearing surface.

16. A lamp as defined in claim 14, wherein said sleeve includes a locking member having a first end attached to said base portion and a second, free end located near a lower surface of said base portion.

17. A lamp as defined in claim 16, wherein said locking member is located at an inside portion of said sleeve adjacent said interior passage.

18. A lamp as defined in claim 17, wherein said free end of said locking member is spaced from said base portion by a clearance space.

19. A lamp as defined in claim 16, wherein said sleeve includes a pair of said locking members located on opposite sides of said interior passage.

20. A lamp as defined in claim 19, wherein each of said locking members includes at least one wall with the walls of said locking members coacting with said sealed end of said envelope to center said sleeve on said sealed end.

* * * * *

UNITED STATES PATENT AND TRADEMARK OFFICE

CERTIFICATE OF CORRECTION

PATENT NO. : 6,815,878 B2
DATED : November 9, 2004
INVENTOR(S) : Bryant

It is certified that error appears in the above-identified patent and that said Letters Patent is hereby corrected as shown below:

Column 6,
Line 41, replace "said inferior passage" with -- said interior passage --

Signed and Sealed this

Fifth Day of April, 2005

JON W. DUDAS
*Director of the United States Patent and Trademark Office*